US011330916B1

(12) United States Patent
Zhang

(10) Patent No.: US 11,330,916 B1
(45) Date of Patent: May 17, 2022

(54) SIDE STRUCTURE OF FENCE FRAME, FENCE FRAME, FENCE AND FOLDING METHOD THEREOF

(71) Applicant: Xiamen Honor Industry and Trading Co., Ltd., Fujian (CN)

(72) Inventor: Jianyong Zhang, Fujian (CN)

(73) Assignee: Xiamen Honor Industry and Trading Co., Ltd., Xiamen (CN)

( * ) Notice: Subject to any disclaimer, the term of this patent is extended or adjusted under 35 U.S.C. 154(b) by 0 days.

(21) Appl. No.: 17/587,348

(22) Filed: Jan. 28, 2022

(30) Foreign Application Priority Data

Sep. 29, 2021 (CN) ..... 202111151120.8

(51) Int. Cl.
*A47D 13/06* (2006.01)
*E04H 17/18* (2006.01)

(52) U.S. Cl.
CPC ..... *A47D 13/063* (2013.01); *E04H 17/18* (2013.01)

(58) Field of Classification Search
CPC .... A47D 13/06; A47D 13/061; A47D 13/063; A47D 13/066; A47D 13/068; E04B 1/343; E04B 1/34357; E04B 1/34384; E04B 1/344; E04H 17/18; E04H 17/185
See application file for complete search history.

(56) References Cited

U.S. PATENT DOCUMENTS 639,703 A * 12/1899 Bent ..... A47D 13/063 5/99.1
3,063,065 A * 11/1962 Shaw ..... A47D 13/063 5/99.1
3,474,472 A * 10/1969 Hamilton ..... A47D 13/063 5/98.1
4,070,716 A * 1/1978 Satt ..... A47D 13/063 5/99.1
10,609,895 B2 * 4/2020 Ishisako ..... A01K 1/035
11,109,691 B2 * 9/2021 Fusco ..... A47D 13/061
11,147,392 B2 * 10/2021 Mountz ..... A47D 9/005
11,206,932 B2 * 12/2021 Ning ..... A47D 9/00

FOREIGN PATENT DOCUMENTS

CN 205696843 U * 11/2016
CN 112294031 A * 2/2021
CN 113180411 A * 7/2021
CN 113679206 A * 11/2021

* cited by examiner

*Primary Examiner* — Jonathan P Masinick
(74) *Attorney, Agent, or Firm* — Cooper Legal Group, LLC

(57) ABSTRACT

Embodiments provides a side structure of a fence frame, a fence frame, and a folding method. In the embodiments, the side structure includes two vertical struts, between which is provided: two upper rods provided horizontally, adjacent ends of them can be connected relatively rotatably, and remote ends of them are respectively detachably provided above the two vertical struts, the two upper rods are rotated downward to approach each other after disassembly; two lower rods provided horizontally provided, adjacent ends of them can be connected relatively rotatably, remote ends of them are rotated downward relative to the lower ends of the two vertical struts to approach each other; two diagonal struts, adjacent ends of them are rotatably connected to the intersection of the two upper rods, and remote ends of them can rotate upward relative to the lower ends of the vertical struts to approach each other.

13 Claims, 19 Drawing Sheets

SIDE STRUCTURE OF FENCE FRAME, FENCE FRAME, FENCE AND FOLDING METHOD THEREOF

RELATED APPLICATIONS

The present disclosure claims priority to Chinese Patent Application No. 202111151120.8, filed on Sep. 29, 2021, which is incorporated herein by reference.

TECHNICAL FIELD

The present disclosure relates to a technical field of fences, and in particular, to a side structure of fence frame, a fence frame, a fence and a folding method.

BACKGROUND

For young children who have just learned to crawl or walk, it is very necessary to use a child fence to limit them to play in a specific safe area. Existing children's fences are mostly made of breast board spliced together. When transporting such children's fences, they are usually disassembled into separate fences for transportation. Consumers need to splice them by themselves after purchasing. When they need to be stored, consumers are also required to disassemble the fence into separate fences, it is very inconvenient no matter whether it is spliced or stored. Because the fences are simply spliced together, the stability is poor, and it is easy to collapse or fall apart under the strong shaking of children.

SUMMARY

The technical problem to be solved by the present disclosure is how to improve the strength of the fence frame and how to solve the problems of splicing and storage inconvenience existing in the prior art.

In order to solve the above-mentioned technical problem, the present disclosure provides a side structure of fence frame, including two vertical struts provided at intervals; between the two vertical struts the fence frame is provided with:

Two upper rods provided horizontally, remote ends of the two upper rods being respectively detachably connected to upper ends of the two vertical struts, adjacent ends of the two upper rods being rotatably connected relative to each other, and the two upper rods rotating downward after disassembled from the upper ends of the two vertical struts to approach each other;

And two lower rods provided horizontally, remote ends of the two lower rods being respectively configured to be rotatable relative to lower ends of the two vertical struts, adjacent ends of the two lower rods being rotatably connected relative to each other, and the two lower rods approaching each other by rotating upward relative to the lower ends of the two vertical struts;

And two diagonal struts, remote ends of the two diagonal struts being respectively provided to be rotatable relative to the lower ends of the two vertical struts, adjacent ends of the two diagonal struts being respectively rotatably connected to an intersection of the two upper rods, and the two diagonal struts approaching each other by rotating upward relative to the lower ends of the two vertical struts.

The present disclosure also provides a fence frame, including a plurality of side structures of the above-described fence frame provided along a peripheral direction, and adjacent side structures of the fence frame sharing a same vertical strut. That is, the fence frame includes a plurality of the vertical struts provided at intervals in the peripheral direction. Between the adjacent two vertical struts is provided with:

Two upper rods provided horizontally, remote ends of the two upper rods being respectively detachably connected to upper ends of the two vertical struts, adjacent ends of the two upper rods being rotatably connected relative to each other, and the two upper rods rotating downward after disassembled from the upper ends of the two vertical struts to approach each other;

And two lower rods provided horizontally, remote ends of the two lower rods being respectively configured to be rotatable relative to lower ends of the two vertical struts, adjacent ends of the two lower rods being rotatably connected relative to each other, and the two lower rods approaching each other by rotating upward relative to the lower ends of the two vertical struts;

And two diagonal struts, remote ends of the two diagonal struts being respectively configured to be rotatable relative to the lower ends of the two vertical struts, adjacent ends of the two diagonal struts being respectively rotatably connected to an intersection of the two upper rods, and the two diagonal struts approaching each other by rotating upward relative to the lower ends of the two vertical struts.

Preferably, the adjacent ends of two upper rods and the adjacent ends of the two diagonal struts are rotatably connected to an intermediate connector.

Preferably, each of the lower ends of the two vertical struts is connected to a lower corner connector, the remote ends of the two lower rods being respectively configured to be rotatable relative to the lower ends of the two vertical struts and the remote ends of the two diagonal struts being respectively configured to be rotatable relative to the lower ends of the two vertical struts are respectively rotatably connected to the lower corner connector.

Preferably, the adjacent ends of the two lower rods are connected by a quick-lock connector, and the quick-lock connector has a first locking position restricting the two lower rods from being rotated relative to each other; and a first unlocking position that allows the two lower rods to rotate relative to each other.

Preferably, the two lower rods are respectively a first lower rod and a second lower rod, the quick-lock connector comprises a first connecting mechanism, a second connecting mechanism and a first spring, the first connecting mechanism is connected with the first lower rod; one end of the second connecting mechanism is connected with the second lower rod and capable to move along a length direction of the second lower rod, the first spring is provided in the second lower rod and abuts between the second connecting mechanism and the second lower rod, and the second connecting mechanism is non-rotatably matched with the first connecting mechanism in the first locking position, and is rotatably matched with the first connecting mechanism when moving to the first unlocking position.

Preferably, the second lower rod is provided with a first bar-shaped hole along the length direction, and the second connecting mechanism is provided in the first bar-shaped hole and configured to move along the first bar-shaped hole.

Preferably, the first connecting mechanism comprises a first connector and a connecting piece, the first connector is sleeved on an outer periphery of the first lower rod, one end of the connecting piece is disposed in the first lower rod, and the first connector and the connecting piece are fixedly connected with the first lower rod through a fastener.

Preferably, the second connecting mechanism comprises a first control and a linkage, one end of the linkage is inserted into the second lower rod, a second end of the linkage is non-rotatably matched with the connecting piece; the first control is sleeved on an outer periphery of the second lower rod, and the first control and the linkage are connected in the first bar-shaped hole of the second lower rod.

Preferably, the second connecting mechanism further comprises a second connector, the second connector is sleeved on the outer periphery of the second lower rod, and on outer peripheries of the linkage and the connecting piece, the second connector is located between the first control and the first connector, the second connector is connected with the linkage at a first connecting position and is configured to move along a length direction of the linkage, and the second connector is rotatably connected with the connecting piece at a second connecting position.

Preferably, each of the two upper rods is detachably connected to the upper end of a corresponding one of the two vertical struts through an upper corner connector, the upper corner connector comprises a fixing piece and a third connecting mechanism detachably connected to the fixing piece, the upper end of the corresponding one of the two vertical struts is fixed on the fixing piece, and each of the upper rods is fixed on the third connecting mechanism.

The present disclosure provides a fence, comprising the fence frame as described above, a fabric cover covering sides and a bottom of the fence frame, and an operate structure for driving the fence frame to fold to a middle.

The present disclosure provides a method for folding, a fence including the fence frame, a fabric cover covering sides and a bottom of the fence frame, and an operate structure for driving the fence frame to fold to a middle; the fence frame includes a plurality of the vertical struts provided at intervals in a peripheral direction, between the adjacent two vertical struts of the plurality of vertical struts is provided with: two upper rods provided horizontally, remote ends of the two upper rods being respectively detachably connected to upper ends of the two vertical struts, adjacent ends of the two upper rods being rotatably connected relative to each other, and the two upper rods rotating downward after being disassembled from the upper ends of the two vertical struts to approach each other; two lower rods provided horizontally, remote ends of the two lower rods being respectively configured to be rotatable relative to lower ends of the two vertical struts, adjacent ends of the two lower rods being rotatably connected relative to each other, and the two lower rods approaching each other by rotating upward relative to the lower ends of the two vertical struts; and two diagonal struts, remote ends of the two diagonal struts being respectively configured to be rotatable relative to the lower ends of the two vertical struts, adjacent ends of the two diagonal struts being respectively rotatably connected to an intersection of the two upper rods, and the two diagonal struts approaching each other by rotating upward relative to the lower ends of the two vertical struts, and the operate structure can be a rope connected to the fence frame or a pull ring fixed in the middle of the fabric cover;

The method for folding comprises the steps of: disassembling the upper rods of the fence frame from the upper ends of the plurality of vertical struts; rotating the upper rods disassembled from the upper ends of the plurality of vertical struts downward, rotating the lower rods upward relative to the lower ends of the plurality of vertical struts, and rotating the diagonal struts upward relative to the lower ends of the plurality of vertical struts; and driving, by the operate structure, the fence frame to fold to the middle.

Additional aspects and advantages of the present disclosure will be given in part in the following description, part will become obvious from the following description, or be learned through the practice of the present disclosure:

1. The sides of the fence of the present disclosure are all formed by the upper rods, the lower rods, the vertical struts and the diagonal struts, which are in a plurality of triangular combined structures, and the whole is very stable and firm;

2. When the fence frame of the present disclosure needs to be folded, the two upper rods can be first disassembled from the upper ends of the support rods, and then the upper rods, the lower rods, and the diagonal struts are rotated correspondingly and approach each other. The side structures in each of the fence frame are concentrated in the middle of the fence after being folded. The overall volume is small, and the overall folding is more convenient.

BRIEF DESCRIPTION OF DRAWINGS

In order to more clearly illustrate the specific embodiments of the present disclosure or the technical solutions in the prior art, the accompanying drawings that need to be used in the description of the specific embodiments or the prior art will be briefly introduced below. Similar elements or parts are generally identified by similar reference numerals throughout the drawings. In the drawings, each element or section is not necessarily drawn to actual scale.

Note:

100, fence frame; 200, fabric cover; 300, operate structure;

1, upper rod frame; 11, first upper rod; 12, second upper rod; 2, lower rod frame; 21, first lower rod; 22, second lower rod; 221, limit pin; 222, first bar-shaped hole; f223, fourth connecting position;

3, quick-lock connector; 31, first connector; 311, sleeve portion; 312, insert portion; 32, second connector; 321, first connecting position; 322, second connecting position; 323, third notch; 324, fourth notch; 33, first control; 34, first spring; 35, connecting piece; 351, connecting hole; 352, lower convex connecting part; 353, first notch; 36, linkage; 361, fifth connecting position; 362, sixth connecting position; 363, seventh connecting position; 364, extension;

4, vertical strut;

5, lower corner connector; 51, first connecting groove; 52, second connecting groove; 53, third connecting grooves;

6, upper corner connector; 61, fixing piece; 611, convex rail; 612, locking hole; 62, third connector; 621, slot; 622, second operating notch; 63, second control piece; 64, second spring; 631, third bar-shaped hole; 632, operating portion; 633, locking end; 634, boss; 635, engaging portion;

7, intermediate connector; and

8, diagonal strut.

DESCRIPTION OF EMBODIMENTS

Embodiments of the technical solutions of the present disclosure will be described in detail below with reference to the accompanying drawings. The following embodiments are only used to illustrate the technical solutions of the present disclosure more clearly, so they are only used as examples, and cannot be used to limit the protection scope of the present disclosure.

It should be noted that, unless otherwise specified, the technical terms or scientific terms used in the present disclosure should be the usual meanings understood by those skilled in the art to which the present disclosure belongs.

Figure 1:
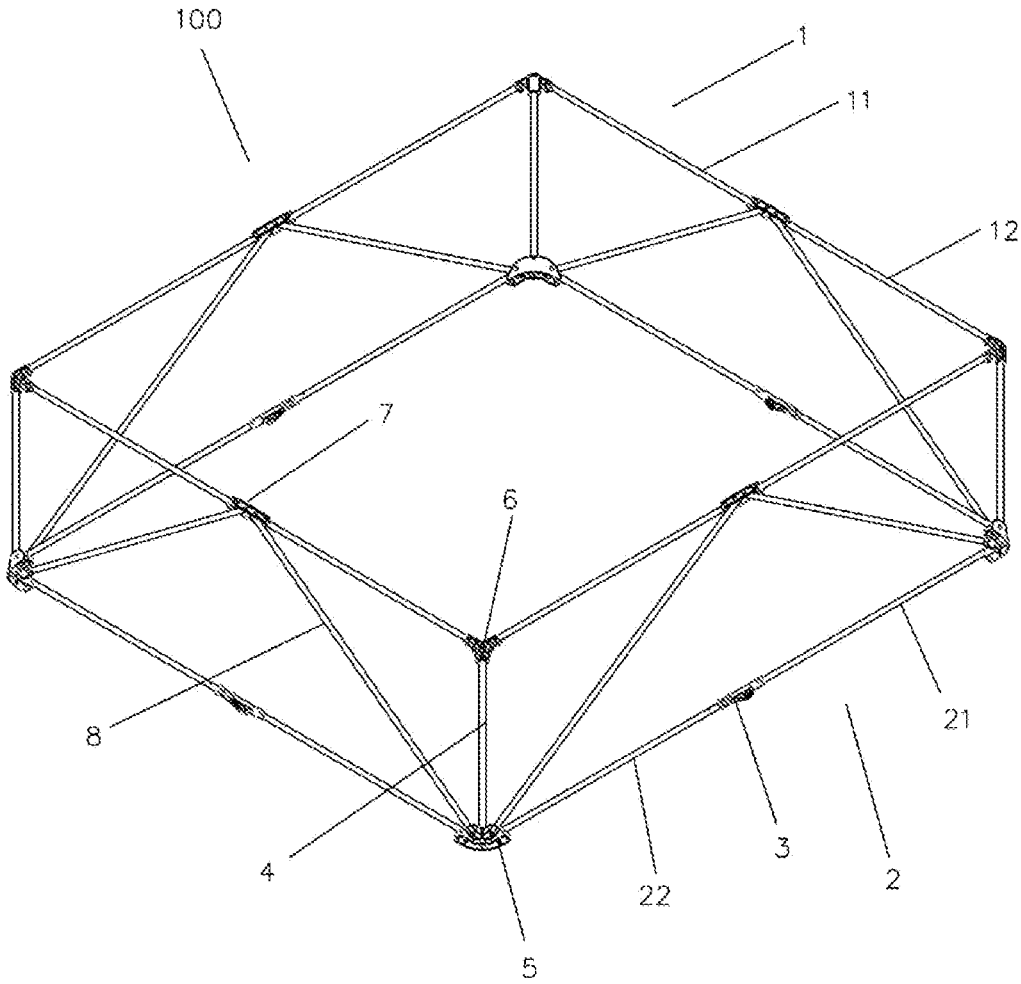
FIG. 1 shows a structure schematic diagram of a foldable children's fence frame provided by a first embodiment of the present disclosure.
Figure 2:
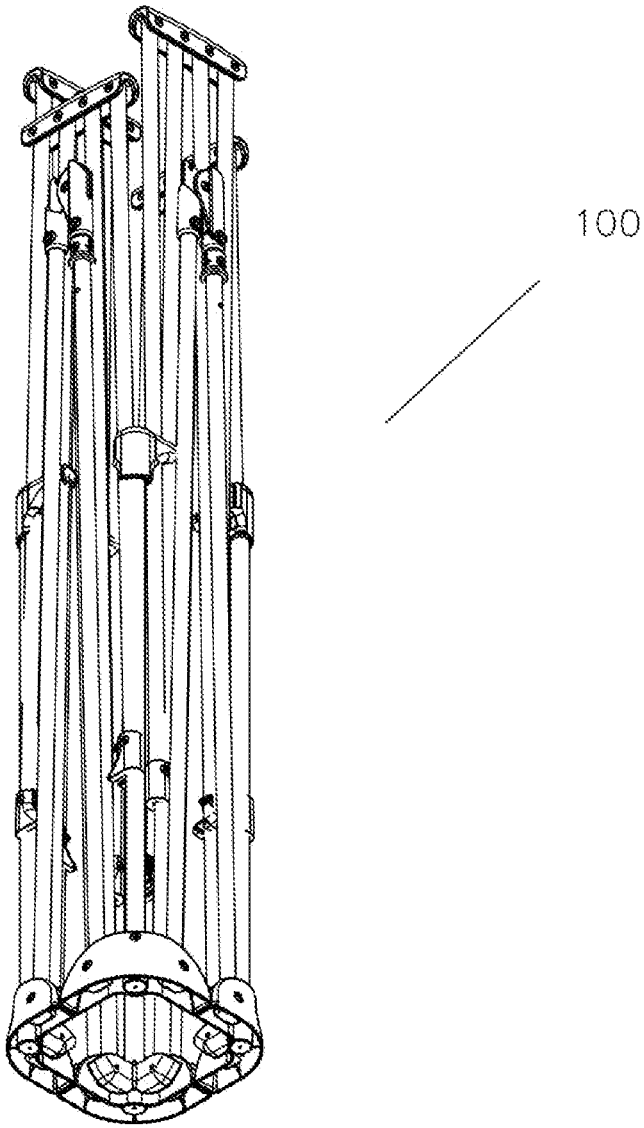
FIG. 2 shows a schematic structural diagram of the foldable children's fence frame provided by the first embodiment of the present disclosure in a folded state.
Figure 3:
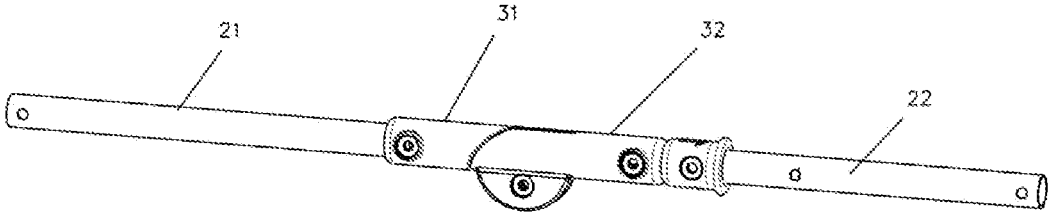
FIG. 3 shows a schematic structural diagram of a quick-lock connector provided by the first embodiment of the present disclosure.

Embodiment 1: referring to FIG. 1 to FIG. 2, in the present embodiment, the present disclosure provides a foldable children's fence frame 100, including an upper rod frame 1, a lower rod frame 2, vertical struts 4, diagonal struts 8, upper corner connectors 6, lower corner connectors 5, intermediate connectors 7, and quick-lock connectors 3. As shown in FIG. 1, the fence frame 100 may include four side structures provided along an outer periphery direction, and the adjacent side structures share a vertical strut. Four vertical struts may be provided at intervals along the outer periphery direction of the fence frame 100.

The upper rod frame 1 is a frame structure formed and enclosed by a plurality of upper rods, and each side of the upper rod frame 1 may be formed by connecting the first upper rod 11 and the second upper rod 12 in the middle, As shown in FIG. 1, the two upper rods may be provided horizontally; each side of the lower rod frame 2 may be enclosed by a plurality of lower rods, and is a frame structure corresponding to the upper rod frame 1. Each side may be formed by connecting the first lower rod 21 and the second lower rod 22 in the middle. As shown in FIG. 1, the two lower rods may be provided horizontally; the vertical strut 4 may be supported at the corner between the upper rod frame 1 and the lower rod frame 2. The lower end of the diagonal strut 8 may be supported at the corner of the lower rod frame 2, and the upper end of the diagonal strut 8 may be supported in the middle of the side of the upper rod frame 1. Combining with FIGS. 1 and 2, the remote ends of the two upper rods may be respectively detachably connected to the upper ends of the two vertical struts 4, and the adjacent ends of the two upper rods may be connected rotatably relative to each other. After the two lower rods are disassembled at the upper end of the vertical strut 4, they approach each other by rotating downwards. The remote ends of the two lower rods may be respectively provided to be rotatable relative to the lower ends of the two vertical struts 4, and the adjacent ends of the two lower rods can be connected relatively rotatably. The two lower rods approach each other by rotating upward relative to the lower ends of the vertical struts 4. The remote ends of the two diagonal struts may be respectively provided to be rotatable relative to the lower ends of the two vertical struts 4, and the adjacent ends of the two diagonal struts are respectively rotatably connected to an intersection of the two upper rods, and the two diagonal struts approach each other by rotating upward relative to the lower ends of the vertical struts.

The remote ends of the first upper rod 11 and the second upper rod 12 may be detachably connected with the upper end of the vertical strut 4 at the upper corner by an upper corner connector 6. The lower ends of the first lower rod 21, the second lower rod 22, and the diagonal strut 8 may be rotatably connected to the lower corner connector 5 at the lower corner, so as to be rotatable relative to the lower end of the vertical strut 4. The upper ends of the first upper rod 11, the second upper rod 12 and the diagonal strut 8 may be rotatably connected to the intermediate connector 7 in the middle of the side of the upper rod frame 1, that is, the adjacent ends of the two upper rods, the adjacent ends of the two diagonal struts may be connected to the intermediate connector 7. The first lower rod 21 and the second lower rod 22 may be connected in the middle of the side of the lower rod frame 2 by a quick-lock connector 3, that is, the adjacent ends of the two lower rods may be connected by a quick-lock connector 3.

The quick-lock connector 3 may have a first locking position and a first unlocking position. When the fence is unfolded form a folded state to an open state, the first lower rod 21 and second lower rod 22 may be rotated to an included angle of 180°, the quick-lock connector 3 moves from the first unlocking position to the first locking position. Referring to FIG. 1 and FIG. 2, when the quick-lock connector 3 is in the first unlocking position, the two lower rods can be rotated upward relative to the lower end of the vertical strut 4 to approach each other.

The upper rod frame 1 forms the upper structure of fence frame 100, the lower rod frame 2 forms the lower structure of fence frame 100, and the vertical strut 4 and the diagonal strut 8 are used to support upper rod frame 1 and lower rod frame 2, to form a side structure of the fence frame 100. The sides of the upper and lower rod frames may be formed by connecting two upper and lower rods respectively. When opened, the fence frame 100 is presented as a closed enclosure structure, which can restrain children located in the fence frame 100 to move within its enclosed range. When folded, the upper rod, the lower rod, the vertical strut 4 and the diagonal strut 8 forming the fence frame 100 may be all vertical structures, which are convenient for transportation and storage.

The upper rod of the fence frame 100 of the present disclosure and the upper end of the vertical strut 4 may be detachably connected by the upper corner connector 6, so that the remote ends of the two upper rods are detachably connected to the upper ends of the two vertical struts 4. The lower ends of the lower rod and the diagonal strut 8 may be rotatably connected to the lower corner connector 5 at the lower corner, so that the remote ends of the two lower rods can rotate relative to the lower ends of the two vertical struts 4, and the remote ends of the two diagonal struts can rotate relative to the lower ends of the two vertical struts 4. The upper rods and the upper ends of the diagonal struts 8 are rotatably connected to the intermediate connector 7 in the middle of the side of the upper rod frame 1, so that the adjacent ends of the two upper rods can be relatively rotatably connected, and the adjacent ends of the two diagonal struts 8 may be respectively rotatably connected to the intersection of the two upper rod bods. The two lower rods on the side of the lower rod frame 2 may be connected by a quick-lock connector 3 in the middle of the side. When opening, the two lower rods forming the side of the lower rod frame 2 rotate relative to each other so that the included angle between them reaches 180°, and the quick-lock connector 3 may be moved from the first unlocking position to the first locking position, so as to realize the two lower rod locked in the middle of the side of the lower rod frame 2, and then the upper rod and the upper end of the vertical strut 4 may be connected and fixed with the upper corner connector 6 at the corner. When folded, the reverse operation can be performed, and it is not repeated herein.

Through the above-mentioned structure, the fence of the present disclosure can be in an open state when in use, and in a folded state during transportation and storage, which is convenient for transportation and storage. The fence frame 100 is composed of rods and connectors as a whole. It only takes three steps to complete the opening or folding of the fence frame 100, which is very convenient and fast to open and fold. The sides of the fence are formed by the upper rods, the lower rods, the vertical struts 4 and the diagonal struts 8, which are in a plurality of triangular combined structures, and the whole is very stable and firm.

In an exemplary embodiment, the upper rod frame 1 may be a rectangular frame structure enclosed by four first upper rods 11 and four second upper rods 12, and each side of the upper rod frame 1 includes a first upper rod 11 and a second upper rod 12, and one end of the first upper rod 11 and the second upper rod 12 may be connected by an intermediate connector 7. The lower rod frame 2 may be a rectangular frame structure enclosed by four first lower rods 21 and four second lower rods 22, and each side of the lower rod frame 2 includes a first lower rod 21 and a second lower rod 22. One ends of the first lower rod 21 and the second lower rod 22 may be connected by a quick-lock connector 3. Four vertical struts 4 may be provided, and the four vertical struts 4 may be respectively supported at the corners of the upper rod frame 1 and the lower rod frame 2, and forms the rectangular side of the fence frame 100 together with the upper rods and the lower rods. Eight diagonal struts 8 may be provided, and two diagonal struts 8 may be provided on each side of the fence frame 100. The lower end of the diagonal strut 8 may be rotatably connected to the lower corner connector 5, and its upper end may be rotatably connected to the intermediate connector 7, such that the side of the fence frame 100 is formed into a plurality of triangular stable structures.

The upper rods, the lower rods, the vertical struts 4, and the diagonal struts 8 can all be hollow tube structures. In one aspect, the overall weight of fence frame 100 can be reduced, and in the other aspect, it is convenient to be connected with connectors.

Referring to FIGS. 3 to 9, the quick-lock connector 3 has a first locking position and a first unlocking position, and when the fence frame 100 is unfolded to the open state, the quick-lock connector 3 may be moved from the first unlocking position to the first unlocking position, the two lower rods are locked to prevent their rotation and play the role of restricting the relative rotation of the two lower rods. When it needs to be folded, the quick-lock connector 3 is operated to move to the first unlocking position, at this time, the two lower rods can be rotated to realize the folding operation of the fence frame 100.

The quick-lock connector 3 may include a first connecting mechanism, a second connecting mechanism, and a first spring 34. The first connecting mechanism may be connected with the first lower rod 21; the right end of the second connecting mechanism may be connected with the second lower rod 22, and can move along the length direction of the second lower rod 22. The first spring 34 may be provided in the second lower rod 22, and abuts between the second connecting mechanism and the second lower rod 22. The left end of the second connecting mechanism is non-rotatably matched with the first connecting mechanism in the first locking position, and is rotatably matched with the first connecting mechanism when moving to the first unlocking position.

When the quick-lock connector 3 is in the first locking position, the second connecting mechanism and the first connecting mechanism are non-rotatably matched, so that the first lower rod 21 and the second lower rod 22 are in a non-rotatable state. When the quick-lock connector 3 is in the first unlocking position, both the first lower rod 21 and the second lower rod 22 can rotate in opposite directions relative to the quick-lock connector 3 to realize the folding of the fence frame 100.

The second connecting mechanism of the quick-lock connector 3 can be moved to the first unlocking position along the second lower rod 22 under the action of external force to be separated from the first connecting mechanism, and can be reset under the action of the restoring force of the first spring 34 to the first locking position for non-rotatable cooperation with the first connecting mechanism.

A first bar-shaped hole 222 may be provided along the length direction of the second lower rod 22, and the second connecting mechanism may be fixed in the first bar-shaped hole 222 and can move along the first bar-shaped hole 222. When the second connecting mechanism is in the first locking position, the second connecting mechanism is connected to the left end of the first bar-shaped hole 222 of the second lower rod 22 under the action of the spring. At this time, the second connecting mechanism and the first connecting mechanism are non-rotatably matched. When it is necessary to fold the fence frame 100, the second connecting mechanism is moved to the right end, so that the connecting position with the second lower rod 22 becomes the right end of the first bar-shaped hole 222, and reaches the first unlocking position, The second connecting mechanism and the first connecting mechanism are in a rotatable matching state.

The first connecting mechanism may include a first connector 31 and a connecting piece 35, the first connector 31 is sleeved on the outer periphery of the first lower rod 21, and one end of the connecting piece 35 is inserted into the first lower rod 21. The first connector 31 and the connecting piece 35 are fixedly connected to the first lower rod 21 through a fastener.

Specifically, the first connector 31 may include a sleeve portion 311 and an insert portion 312. The sleeve portion 311 may be sleeved on the outer periphery of the insert portion 312, a gap may be provided between the sleeve portion 311 and the insert portion 312, and the sleeve portion is connected to the insert portion 312 at one end, and separated at the other end. The right end of the first lower rod 21 may be inserted into the gap between the sleeve portion 311 and the insert portion 312, so that the sleeve portion 311 is sleeved on the outer periphery of the first lower rod 21, the insert portion 312 may be inserted into the first lower rod 21. An opening for inserting the connecting piece 35 may be provided along the length direction of the insert portion 312, and the left end of the connecting piece 35 may be inserted into the opening. Corresponding connecting holes 351 may be formed on the sleeve portion 311 and the insert portion 312 of the first connector, the first lower rod 21, and the connecting piece 35, and all of three may be fastened together by fasteners. The right end of the connecting piece 35 protrudes out of the first connector 31 to cooperate with the second connecting mechanism.

The second connecting mechanism may include a first control 33 and a linkage 36. The right end of the linkage 36 may be inserted into the second lower rod 22, and its left end may be non-rotatably matched with the connecting piece 35 when in the first locking position and rotatably matched with the connecting piece 35 in first unlocking position. The first control 33 may be sleeved on the outer periphery of the second lower rod 22, and the first control 33 and the linkage 36 are connected in the first bar-shaped hole 222 of the second lower rod 22.

The second connecting mechanism may also include a second connector 32 sleeved on the outer periphery of the second lower rod 22, the linkage 36 and the connecting piece 35, and located between the first control 33 and the first connector 31. The first connecting position 321 of the second connector 32 may be connected with the linkage 36 and can move along the length of the linkage 36, and the second connecting position 322 of the second connector 32 may be rotatably connected with the connecting piece 35.

Specifically, the second lower rod 22 may have a third connecting position and a fourth connecting position 223. The third connecting position may be the first bar-shaped hole 222, the fourth connecting position 223 may be a through hole. The fourth connecting position 223 may be provided at a position close to the end of the second lower rod 22, and the third connecting position may be provided away from the end of the second lower rod 22.

The linkage 36 may include a fifth connecting position 361, a sixth connecting position 362, and a seventh connecting position 363 from right to left. Among them, the fifth connecting position 361 and the seventh connecting position 363 are through holes, and the sixth connecting position 362 is the second bar-shaped hole. The right end of the linkage 36 may be inserted into the second lower rod 22, and its left end extends out of the second lower rod 22. The first control 33 may be sleeved outside the second lower rod 22, and the first control 33 and the five connecting positions 361 of the linkage 36 may be fixedly connected to the third connecting position (i.e., the first bar-shaped hole 222) of the second lower rod 22 through a fastener.

The sixth connecting position 362 of the linkage 36 may be a second bar-shaped hole provided along the length direction of the linkage 36. The second connector 32 may be sleeved on the connecting piece 35, the linkage 36, and the second lower rod 22, and is located between the first connector 31 and the first control 33. The first connecting position 321 of the second connector 32, the fourth connecting position 223 of the second lower rod 22 and the second bar-shaped hole of the linkage 36 are fixed connected by fasteners, so that the second connector 32 and the second lower rod 22 can move along the second bar-shaped hole. When unlocking, by operating the first control 33 to move to the left end, the linkage 36 is driven to move leftward in the first bar-shaped hole 222. At the same time, due to the fourth connecting position 223 of the second lower rod 22 and the first connecting position 321 of the second connector 32 is connected in the second bar-shaped hole, during the movement of the linkage 36 to the left end, the second lower rod 22 and the second connector 32 can remain unchanged relative to the first connecting mechanism. The same goes for the movement of the first unlocking position to the first locking position.

Figure 4:
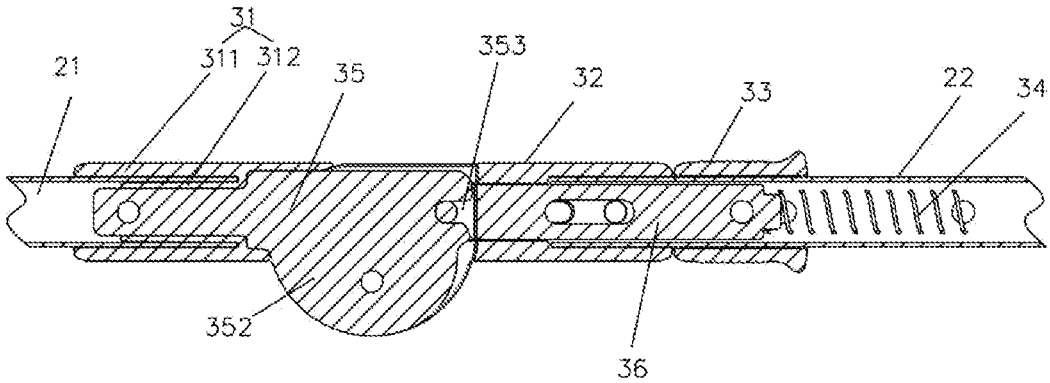
FIG. 4 is a cross-sectional view of the quick-lock connector provided by the first embodiment of the present disclosure.
Figure 5:
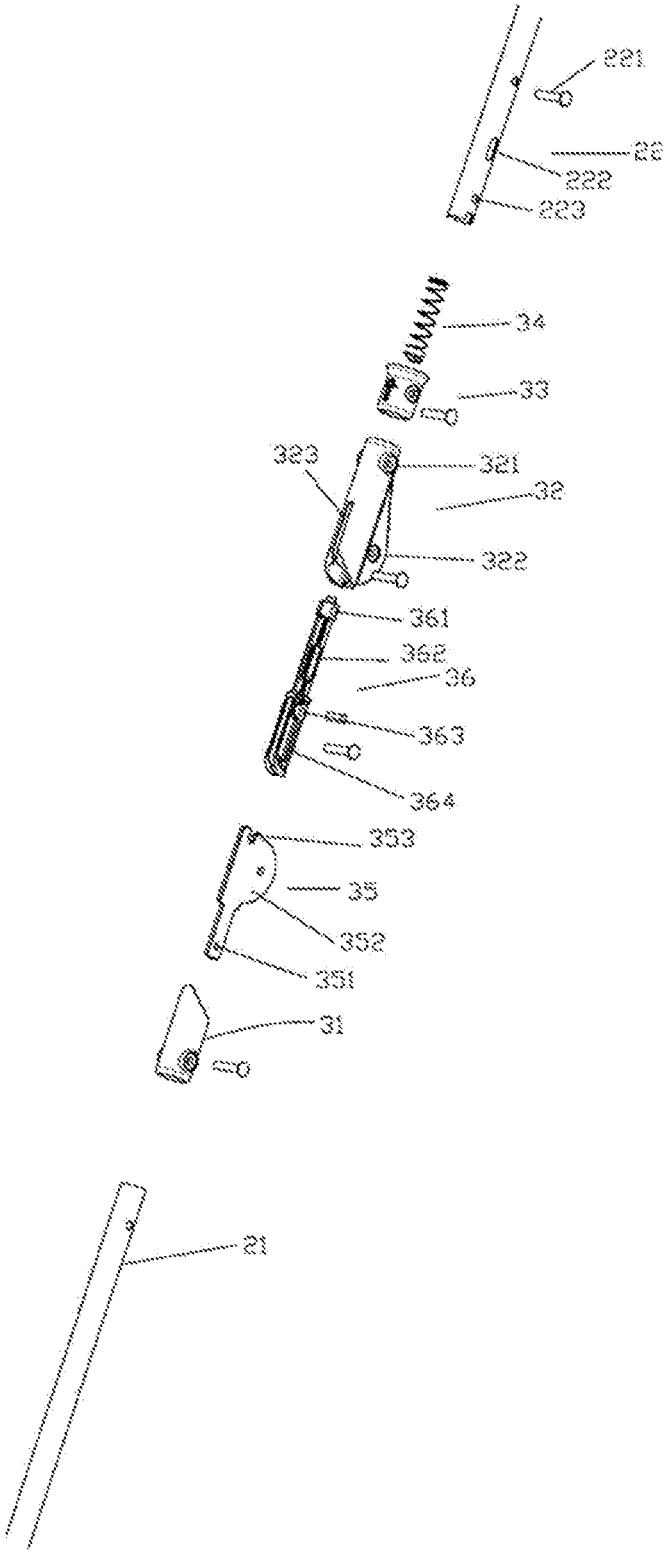
FIG. 5 is an exploded view of the quick-lock connector provided by the first embodiment of the present disclosure.
Figure 6:
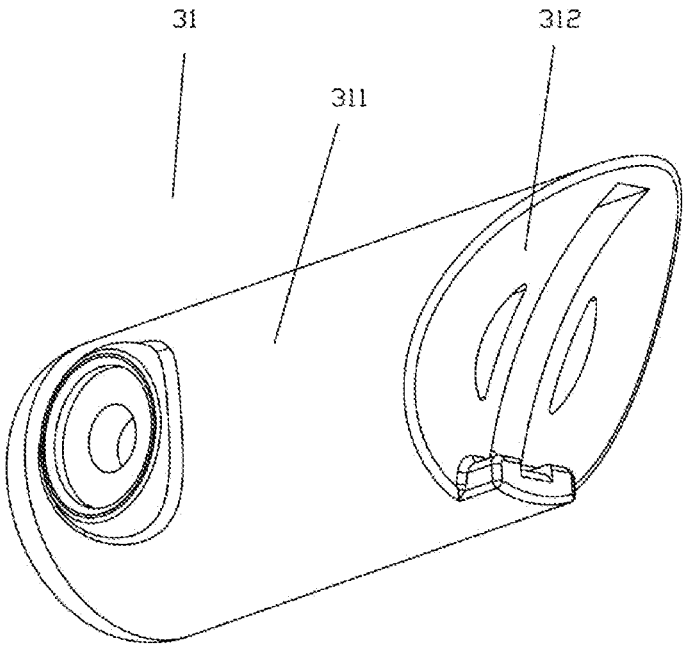
FIG. 6 is a schematic structural diagram of a first connector provided by the first embodiment of the present disclosure.
Figure 7:
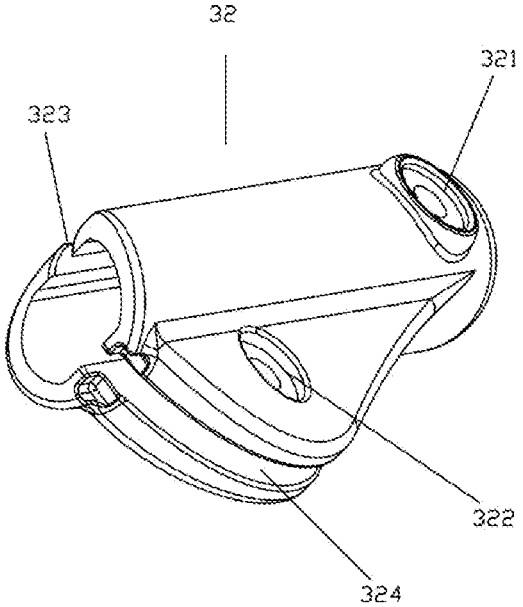
FIG. 7 is a schematic structural diagram of a second connector provided by the first embodiment of the present disclosure.
Figure 8:
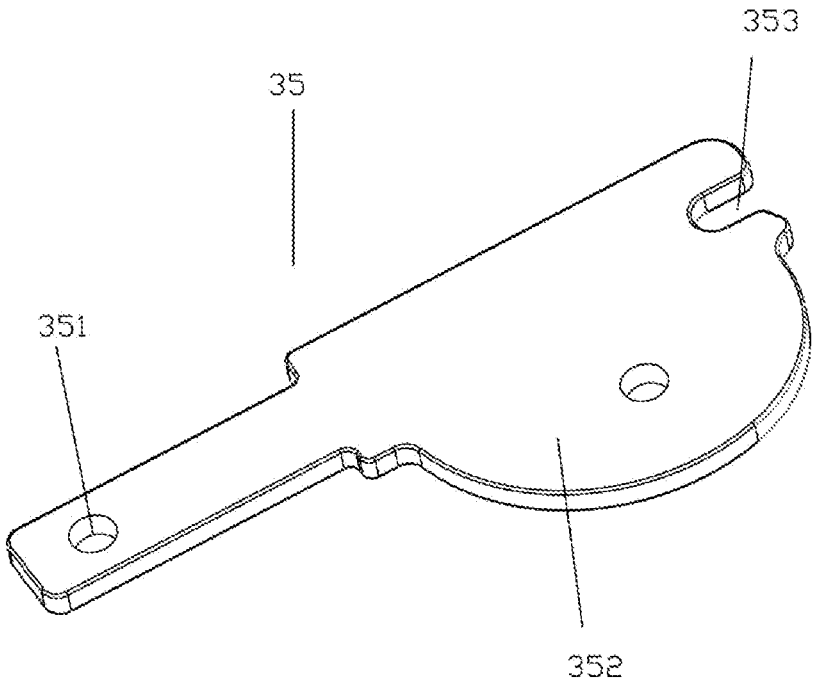
FIG. 8 is a schematic structural diagram of a connecting piece provided by the first embodiment of the present disclosure.
Figure 9:
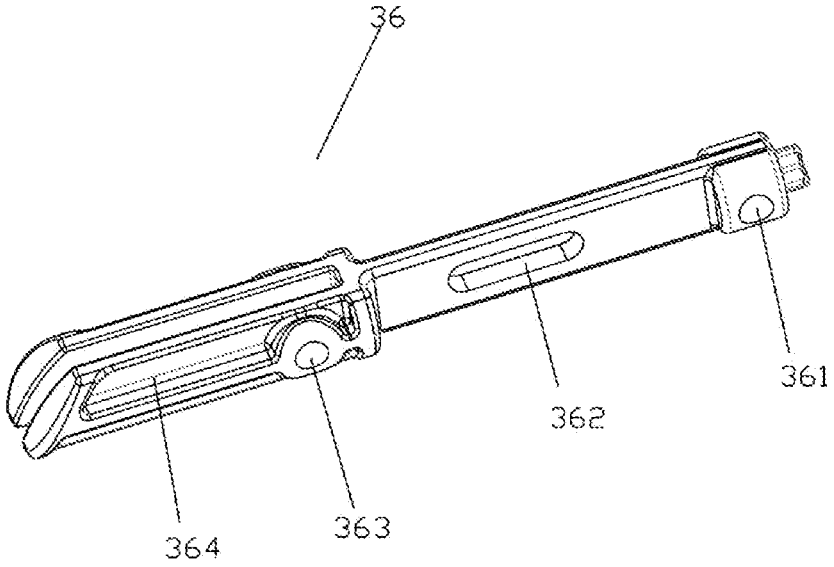
FIG. 9 is a schematic structural diagram of a linkage provided by the first embodiment of the present disclosure.
Figure 10:
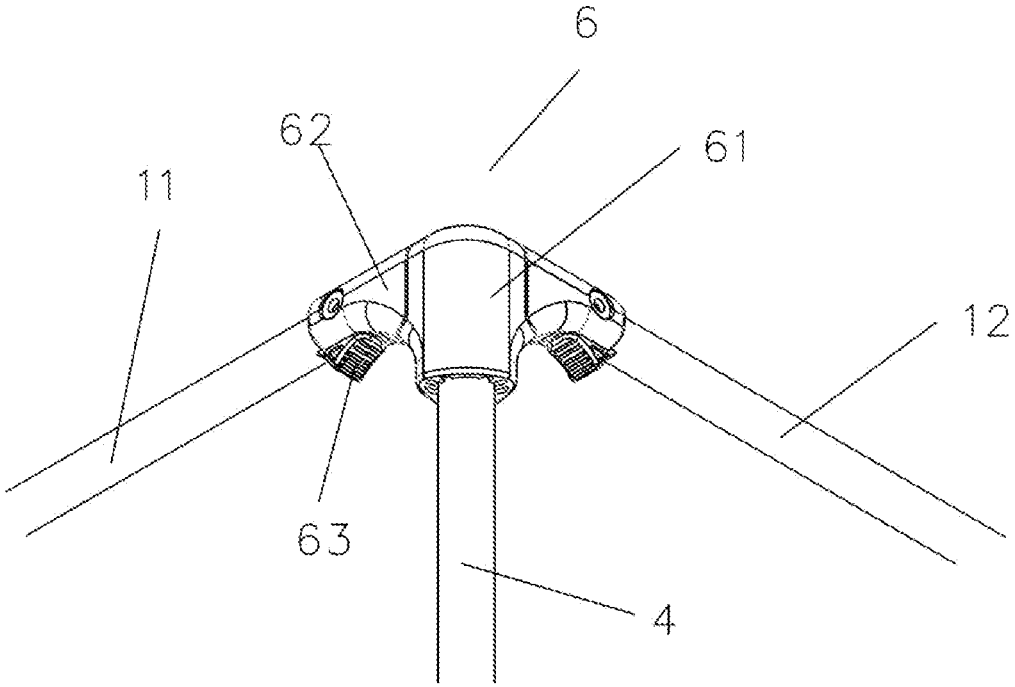
FIG. 10 is a schematic structural diagram of an upper corner connector provided by the first embodiment of the present disclosure.
Figure 11:
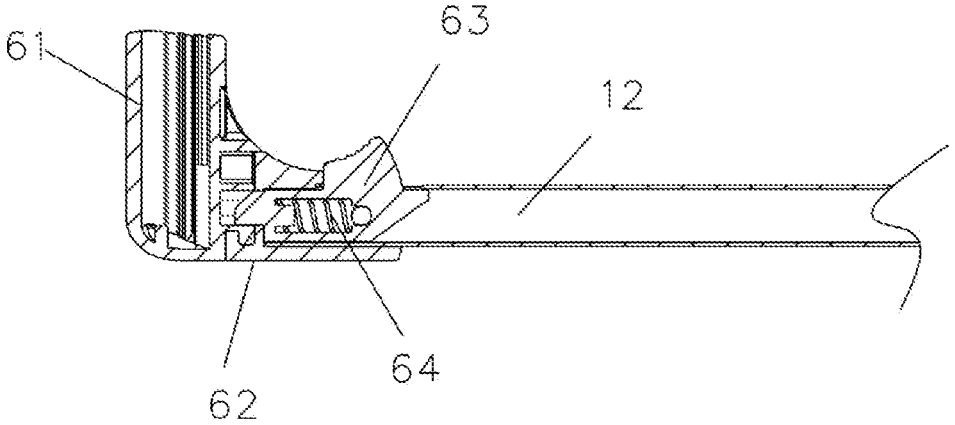
FIG. 11 is a cross-sectional view of the upper corner connector provided by the first embodiment of the present disclosure.
Figure 12:
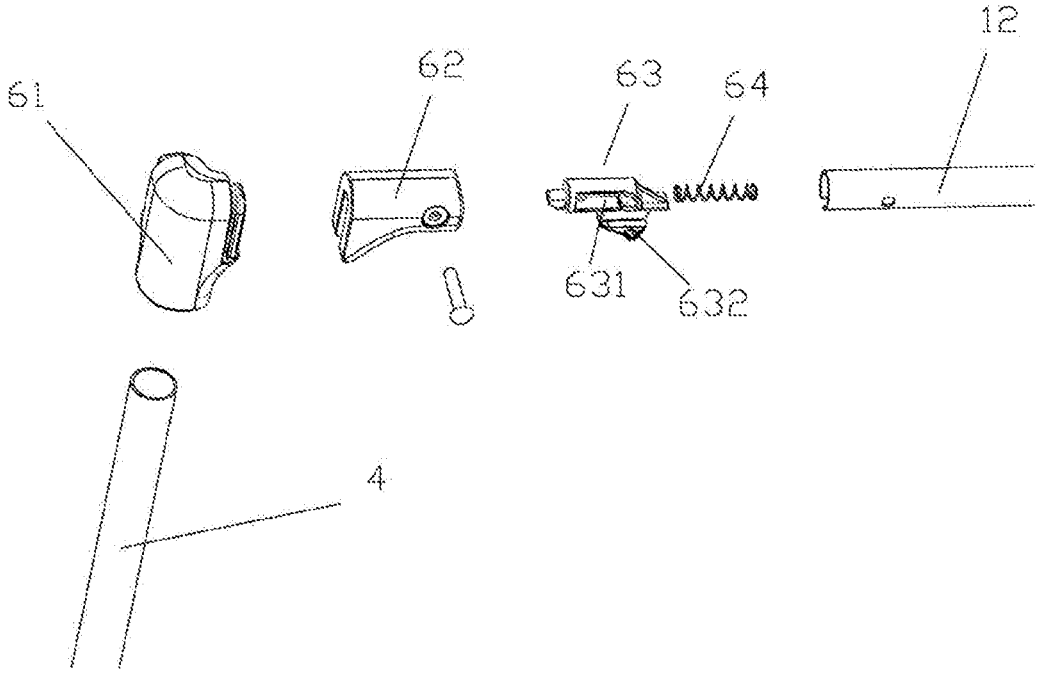
FIG. 12 is an exploded view of the upper corner connector provided by the first embodiment of the present disclosure.
Figure 13:
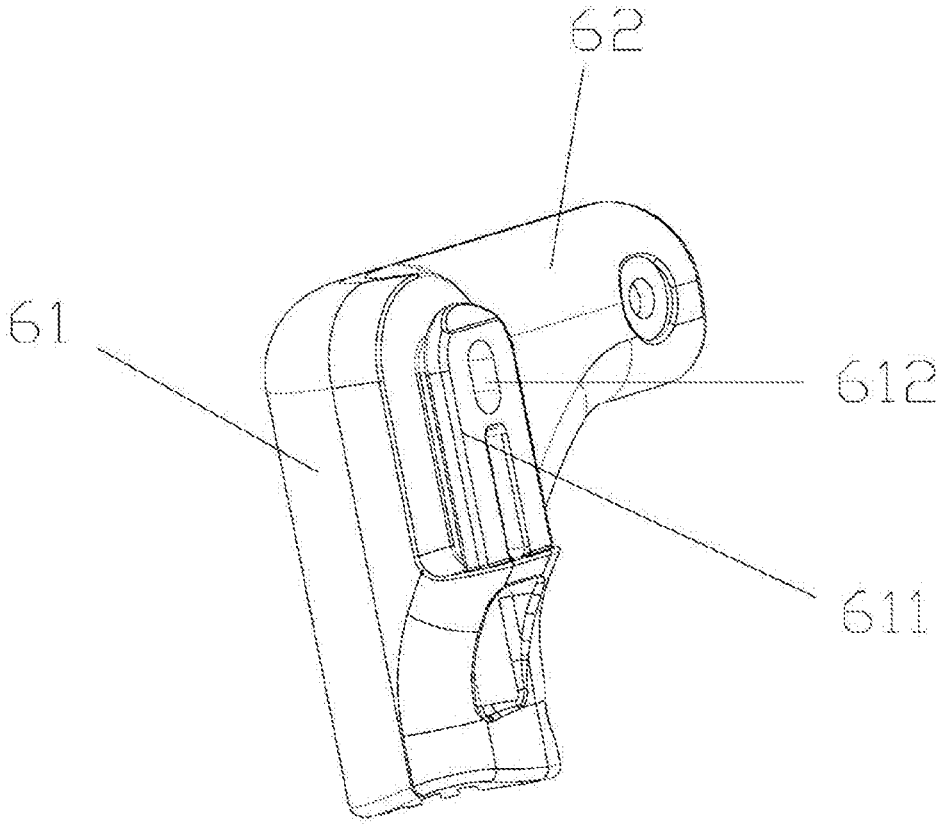
FIG. 13 is a partial structural schematic diagram of the upper corner connector provided by the first embodiment of the present disclosure.
Figure 14:
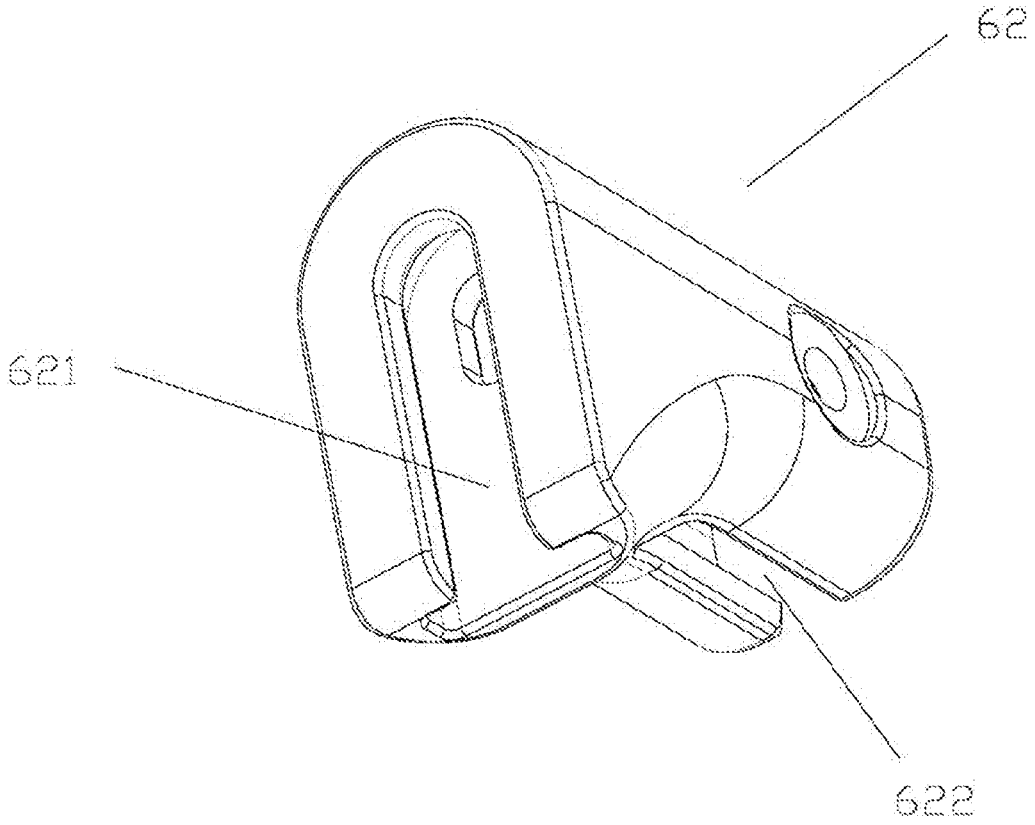
FIG. 14 is a schematic structural diagram of a third connector provided by the first embodiment of the present disclosure.
Figure 15:
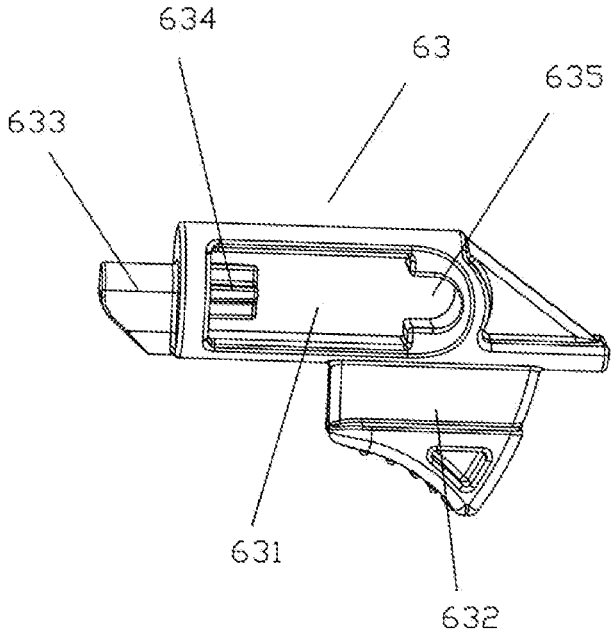
FIG. 15 is a schematic structural diagram of a second control provided by the first embodiment of the present disclosure.
Figure 16:
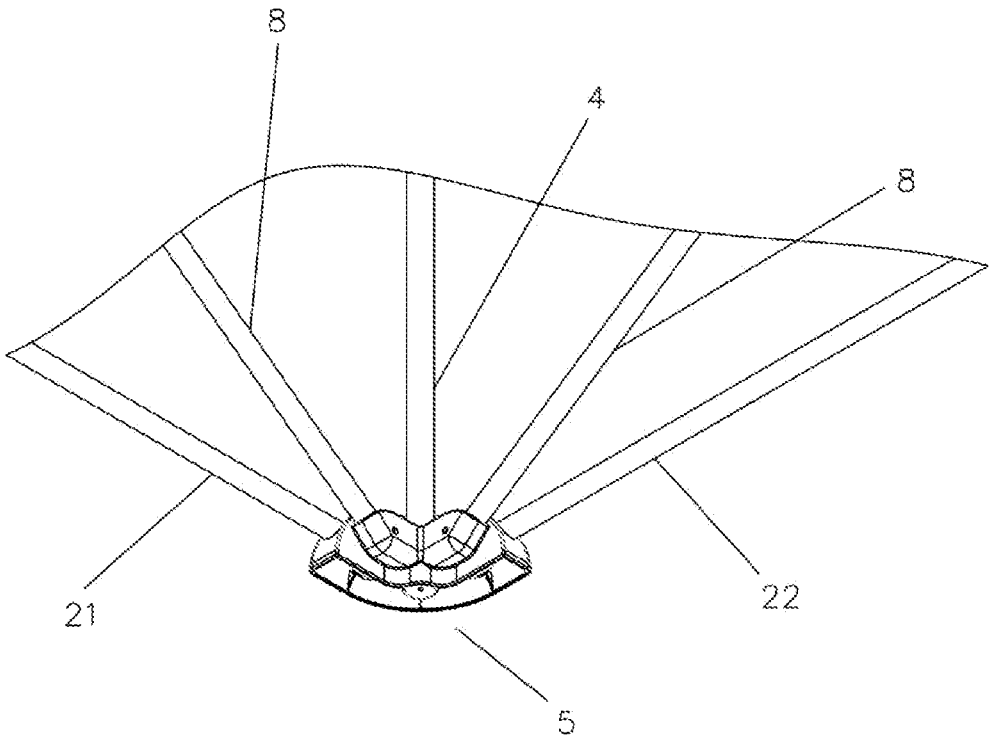
FIG. 16 is a schematic structural diagram of the connection of the lower corner connector provided by the first embodiment of the present disclosure.

The seventh connecting position 363 of the linkage 36 is a through hole, and the connecting piece 35 may be provided with a first notch 353 with one end opening at the left end corresponding to the seventh connecting position 363. Referring to FIGS. 4 and 5, the opening side of the first notch 353 is at the right end. The linkage 36 is connected with the first notch 353 by a pin at the seventh connecting position 363. The lower side of the connecting piece 35 may protrude downward to form a lower convex connecting part 352, and the lower convex connecting part 352 is rotatably connected to the second connector 32 at the second connecting position 322. When the second connecting mechanism is in the first locking position, the pin of the linkage 36 at the seventh position may be matched in the first notch 353, so that the linkage 36 and the connecting piece 35 can be non-rotatably matched. Referring to FIGS. 4 and 5, when the second connecting mechanism moves to the right to the first unlocking position, the linkage 36 moves to the right, and the pin at the seventh position is separated from the first notch 353 and loses the restriction on the connecting piece 35. At this time, the linkage 36 and the connecting piece 35 are rotatable and rotatably matched.

The right end of the linkage 36 may be provided with a protruding, the second lower rod 22 may be provided with a limit part, and the first spring 34 is provided in the second lower rod 22, one end of which is sleeved on the protruding, and the other end abuts the limit part. When the quick-lock connector 3 moves from the first locking position to the first unlocking position, the force acting on the first control 33 causes the linkage 36 to move to the right, and the first spring 34 is compressed by the linkage 36 that moves to the right. When the force acting on the first control 33 disappears, and the first lower rod 21 and the second lower rod 22 rotate relative to each other to an angle of 180°, the linkage 36 moves towards the left under the action of the restoring force of the first spring 34, and is non-rotatably matched with the connecting piece 35.

The limit part may be a step or other structure provided in the second lower rod 22. In the present embodiment, the limit part is a limit pin 221 passing through the lower rod, and the other end of the first spring 34 abuts on the limit pin 221.

The left end of the linkage 36 is also provided with extensions 364, and a second gap is provided along the length direction of the extensions 364, and the right end of the connecting piece 35 is inserted into the second gap of the extensions 364, so that the extensions 364 of the linkage 36 are located on both sides of the upper end of the right of the connecting piece 35. The seventh connecting position 363 of the linkage 36 may be provided on the extension 364.

The second connector 32 may be provided with a third notch 323 for the connecting piece 35 to rotate at its top corresponding to the connecting piece 35. The second connector 32 may be provided with a fourth notch 324 for the connecting piece 35 to rotate at its lower part corresponding to the lower convex connecting part 352 of the connecting piece 35. After unlocking, during the rotation of the first lower rod 21 and the second lower rod 22, the connecting piece 35 is rotated out from the notch at the top of the second connector 32.

Referring to FIGS. 10 to 15, the upper corner connector 6 may include a fixing piece 61 and a third connecting mechanism detachably connected to both sides of the fixing piece 61. The upper end of the vertical strut 4 may be fixed on the fixing piece 61, and the first upper rod 11 and the second upper rod 12 are respectively fixed on the third connecting mechanism on the corresponding side.

When folding, the third connecting mechanisms connected on the first upper rod 11 and the second upper rod 12 are removed from the fixing pieces 61, respectively, so that the first upper rod 11, the second upper rod 12 and the vertical strut 4 are separated from one another.

The lower end of the fixing piece 61 may be provided with an opening, and the upper end of the vertical strut 4 is inserted into the opening and is connected with the fixing piece 61 through a fastener. Two sides of the fixing piece 61 are respectively provided with convex rails 611 protruding outward, and the convex rails 611 on both sides form an included angle of 90°. The size of the outer side of the convex rail 611 may be larger than the size of the inner side thereof, and a limit structure is formed on the outer side thereof. One end of the third connecting mechanism may be provided with an opening, and the corresponding end of the upper rod is inserted into the opening of the third connecting mechanism, and is fixedly connected with the third connecting mechanism through a fastener. The other end of the third connecting mechanism is provided with a slot 621 matched with the convex rail 611, and the lower end of the slot 621 is open. When connecting, the upper end of the convex rail 611 can be slid into the lower end of the slot 621 of the third connecting mechanism. When disassembling, the third connecting mechanism can be drawn out, such that the slot 621 can be separated from the convex rail 611.

In order to realize the locking of the upper corner connector 6, the upper corner connector 6 has a second locking position and a second unlocking position. When the fence frame 100 needs to be folded, the upper corner connector 6 is moved from the second locking position to the second unlocking position, so that the third connecting mechanism can be lifted to be separated from the fixing piece 61. When the fence frame 100 is unfolded, the third connecting mechanism may be matched with the fixing piece 61, and the upper corner connector 6 is moved from the second unlocking position to the second locking position, and at this time, the third connecting mechanism cannot be detached from the fixing piece 61.

Specifically, the third connecting mechanism may include a third connector 62, a second control 63, and a second spring 64. One end of the third connector 62 is provided with an opening, and the upper rod is inserted into the opening and fixedly connected with the third connector 62; the other end of the third connector 62 is provided with a slot 621 through which the third connector 62 is detachably connected with the convex rail 611 on the fixing piece 61. A locking hole 612 is also provided on the convex rail 611 of the fixing piece 61, and the third connector 62 is provided with a through hole for the second control 63 to pass through at the slot 621 corresponding to the locking hole 612. One end of the second control 63 is inserted into the upper rod, a third bar-shaped hole 631 is formed along the second control 63, and the third connector 62 and the upper rod are connected to the second control 63 by fasteners, such as connecting pins, passing through the third bar-shaped hole 631. The second spring 64 may be provided in the third bar-shaped hole 631, one end of the second spring 64 abuts one side of the third bar-shaped hole 631, and the other end abuts the fastener. The other end of the second control 63 is a locking end 633, the locking end 633 protrudes out of the body of the upper rod, and matched and locked with locking hole 612 after passing through the through hole on the slot 621.

Under normal conditions, the locking end 633 of the second control 63 is inserted into the locking hole 612 to limit the relative movement between the slot 621 and the convex rail 611 to achieve locking. When the third connecting mechanism needs to be removed, the third control is operated to move away from the fixing piece 61, the locking end 633 is separated from the locking hole 612, so that the third connecting mechanism can be detached from the fixing piece 61.

In order to facilitate the operation, the lower side of the second control 63 is provided with an operating portion 632, and the upper rod is provided with a first operating notch corresponding to the operating portion 632. The length of the first operating notch is greater than the length of the operating portion 632. The third connector 62 is provided with a second operating notch 622 corresponding to the operating portion 632. The operating portion 632 extends out of the upper rod and the third connector 62 from the first operating notch and the second operating notch 622 to facilitate operation. The length of the first operating notch shall be greater than or equal to the stroke of the third connecting mechanism moving from the second locking position to the second unlocking position.

One end of the third bar-shaped hole 631 may be provided with a concave engaging portion 635, and the fasteners connecting the third connector 62, the upper rod and the second control 63 are located in the engaging portion 635. At the other end of the third bar-shaped hole 631 is provided with a boss 634 protruding toward one end thereof. The second spring 64 may be provided in the third bar-shaped hole 631, one end of which may be sleeved on the boss 634, and the other end may abut on the fastener.

Figure 17:
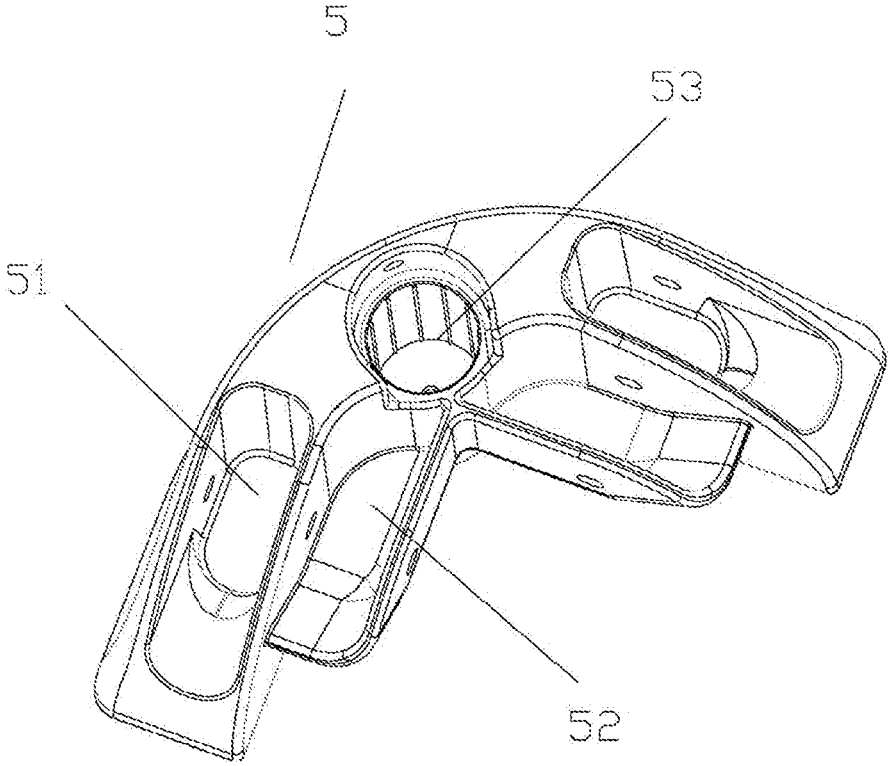
FIG. 17 is a schematic structural diagram of a lower corner connector provided by the first embodiment of the present disclosure.

Referring to FIG. 17, the lower corner connector 5 may include two connecting parts that are symmetrically provided, and one side of the two connecting parts is connected in a vertical state. The two connecting parts may be provided with a first connecting groove 51 for connecting the lower rod, a second connecting groove 52 for connecting the diagonal strut 8 and a third connecting groove 53 for connecting the vertical strut 4. The lower rods located on the two sides are respectively rotatably connected in the first connecting grooves 51, the diagonal struts 8 located on the two sides are respectively rotatably connected in the second connecting grooves 52, and the lower ends of the vertical struts 4 are fixed in the third connecting groove 53.

When the fence frame 100 is folded, the diagonal struts 8 and the lower rods are respectively rotated towards the vertical struts 4 and are in a vertical state. When the fence frame 100 is opened, the diagonal struts 8 and the lower rods are respectively rotated in the direction away from the vertical struts 4, and the lower rod is in a horizontal state.

Two first connecting grooves 51 and two second connecting grooves 52 may be provided, and a third connecting groove 53 is provided. The two first connecting grooves 51 are respectively provided on the two connecting parts, the two second connecting grooves 52 are respectively provided on the two connecting parts, and the third connecting groove 53 is provided at the connection of the two connecting parts.

Specifically, the first connecting groove 51 and the third connecting groove 53 are vertically provided on the connecting part, and the third connecting groove 53 may be provided between the two second connecting grooves 52. The second connecting groove 52 may be vertically provided on the inner side wall of the connecting part.

The lower corner connector 5 can be integrally formed with plastic.

The first connecting groove 51 may be provided with a first limit position and a second limit position. When the lower rod is in the first limit position, it is in a vertical state. When the lower rod is rotated to the second limit position from the first limit position, it rotates from a vertical state to a horizontal state.

The second connecting groove 52 may be provided with a third limit position and a fourth limit position. When the diagonal strut 8 is in the third limit position, it is in the vertical state. When the diagonal strut 8 is rotated to the fourth limit position from the third limit position, it rotates from the vertical state to an inclined state.

During use, when the first lower rods 21 and the second lower rods 22 are at the first limit positions of the first connecting grooves 51, and the diagonal struts 8 are at the third limit positions of the second connecting grooves, the fence is in the folded state. When the first lower rods 21 and the second lower rods 22 are at the second limit positions of the first connecting grooves 51, and the diagonal struts 8 are at the fourth limit positions of the second connecting grooves 52, the fence is in the open state. The corner connector 5 supports a total of five rods on both sides of the fence.

Figure 18:
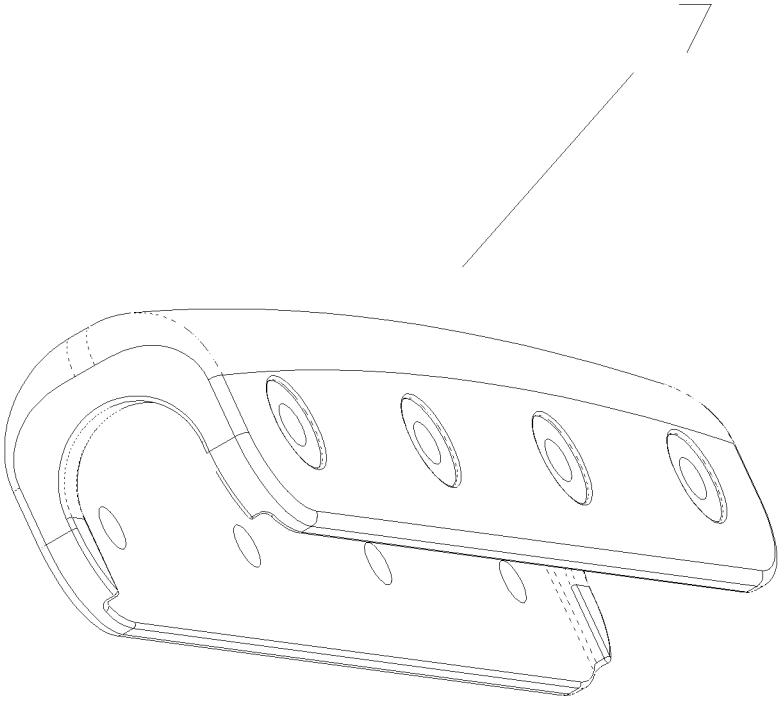
FIG. 18 is a schematic structural diagram of the intermediate connector provided by the first embodiment of the present disclosure.

Referring to FIG. 18, the intermediate connector 7 is the straight bar structure with openings at both ends and the lower side, and is provided with four connecting positions successively along the length direction of the intermediate connector 7, for connecting two upper rods and two diagonal struts 8.

In detail, the first upper rod 11 and the second upper rod 12 are respectively inserted by the two ends of the intermediate connector 7, and are rotatably connected with the connecting positions located on the outside. The upper ends of the two diagonal struts 8 are respectively inserted from the lower side of the intermediate connector 7 in two directions, and are rotatably connected with the connecting position located in the middle.

When the fence frame 100 is opened, the upper rod frame 1 enclosed by the first upper rods 11 and the second upper rods 12 forms the upper part of the fence, and the lower rod frame 2 enclosed by the first lower rods 21 and the second lower rods 22 forms the lower part of the fence. The first upper rod 11 and the second upper rod 12 of each side are connected into a horizontal state through the intermediate connector 7, and the first lower rod 21 and the second lower rod 22 of each side are connected in a horizontal state by the quick-lock connector 3. The upper end of the vertical strut 4 is fixedly connected with the fixing piece 61 of the upper corner connector 6, and the lower end thereof is fixedly connected with the third connecting groove 53 of the lower corner connector 5. The lower end of the diagonal strut 8 is connected obliquely in the second connecting groove 52 of the lower corner connector 5, and the upper end of the diagonal strut 8 is connected obliquely in the middle connecting position of the intermediate connector 7.

When it is necessary to fold, the second control 63 is operated to make the upper corner connector 6 be in the second unlocking position, the third connecting mechanisms fixed on the upper rods are respectively removed from the fixing pieces 61; the first control 33 is operated to make the quick-lock connector 3 be in the first unlocking position, and the first lower rods 21 and the second lower rods 22 are rotated relative to the quick-lock connectors 3; the quick-lock connectors 3 move upward, and the third connecting mechanisms move downward. The quick-lock connectors 3, the intermediate connectors 7, the third connecting mechanisms, the fixing pieces 61, and the lower corner connectors 5 are respectively folded to the middle of the fence frame 100 in a vertical state.

Figure 19:
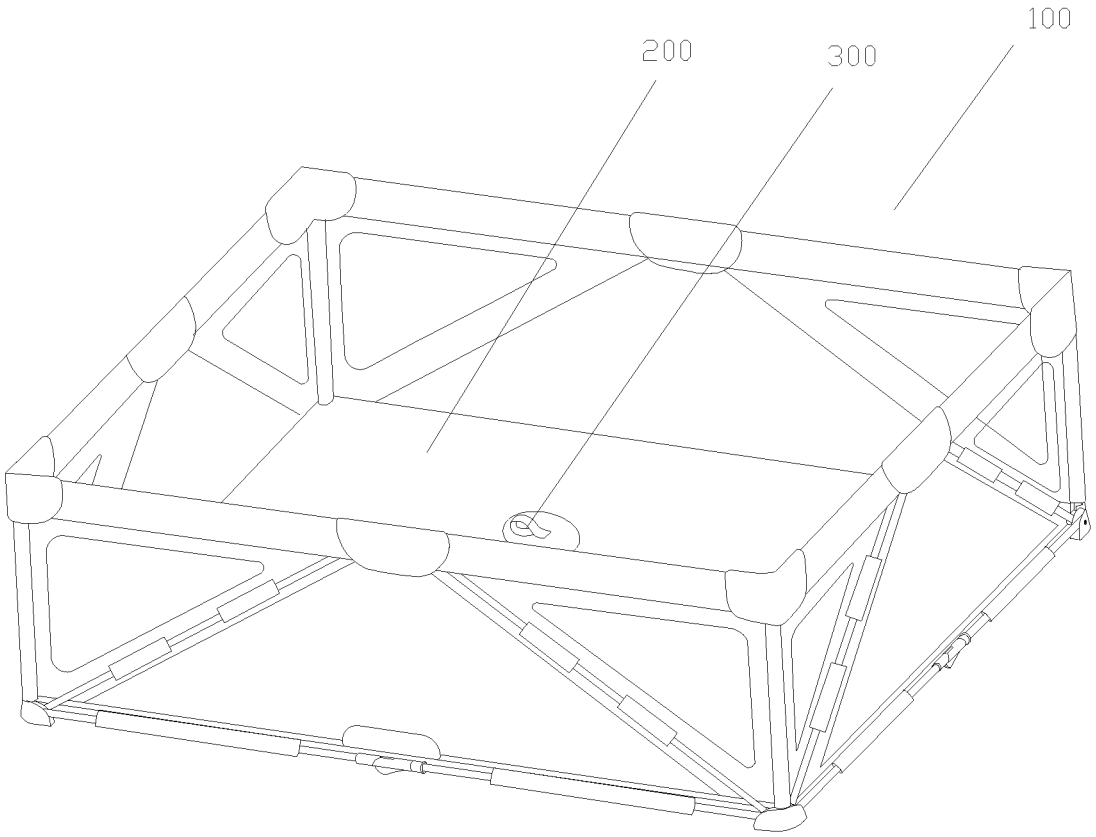
FIG. 19 is a schematic structural diagram of the foldable children's fence provided by a second embodiment of the present disclosure.

Embodiment 2: Referring to FIG. 19, in the present embodiment, a foldable children's fence is provided. The children's fence may include a fence frame 100, a fabric cover 200 and an operate structure 300. The fence frame 100 is the foldable children's fence frame 100 provided in Embodiment 1, the fabric cover 200 covers the sides and bottom of the fence frame 100, and the operate structure 300 is provided in the middle of the fence and connected to the lower corner connectors 5 of the lower rod frame 2 respectively.

By providing the operate structure 300 connected with the lower corner connector 5 of the lower rod frame 2 in the middle of the fence, after the third connecting mechanism is removed and the quick-lock connector 3 is unlocked, the operate structure 300 can drive the lower corner connector 5 of the lower rod frame 2 to move toward the middle of the fence, so as to fold the fence faster and avoid folding the four lower corners in sequence.

The fabric cover 200 covers the inner side of the fence frame 100, the upper end of which is open and the lower end is closed. Specifically, the fabric cover 200 is a rectangular structure matched with the fence frame 100. A sleeve body is vertically provided at the corner of the fabric cover 200, and the sleeve body is sleeved on the outer periphery of the vertical strut 4 to realize the connection between the fabric cover 200 and the vertical strut 4. The upper part of the fabric cover 200 may be provided with a first connecting part, the first connecting part is formed by extending the upper part of the fabric cover 200, the first connecting part and the fabric cover 200 are respectively provided with zippers that cooperate with each other, The upper part of the fabric cover 200 may be fixed on the upper rod by the first connecting part and the zipper. The lower part of the fabric cover 200 may be provided with a strap, and the lower part of the fabric cover 200 is fixed on the corresponding lower rod by the strap.

The operate structure 300 can be a rope with one end connected to the corner of the lower rod frame 2 and the other end concentrated in the middle of the fence. During operating, the four corners of the lower rod frame 2 can be closed by pulling the rope upwards.

The operate structure 300 can also be a pull ring fixed in the middle of the fabric cover 200, and the pull ring is connected to the corner of the lower rod frame 2 through the fabric cover 200 at the bottom. During operation, the pull ring is pulled upwards, the fabric cover 200 connected thereto pulls the four corners of the lower rod frame 2 to fold.

Embodiment 3: in the present embodiment, a method for folding is provided. The foldable children's fence is the foldable children's fence provided in Embodiment 2. The method for folding the fence comprises the steps: S1, disassembling respectively the first upper rods 11 and the second upper rods 12 from the upper corner connector 6; S2, operating the quick-lock connectors 3 to the first unlocking position, rotating the first lower rods 21 and the second lower rods 22 in the direction of approaching each other relative to the quick-lock connector 3 (at this time, the lower rod rotates upward relative to the lower end of the vertical strut), and moving the middle of the side of the lower rod frame 2 and the upper rod frame 1 to the middle of the fence; S3, driving the corner of the lower rod frame 2 to move to the middle of the fence, by upward pulling the operate structure 300, until the corners of the lower rod frame 2 and the upper rod frame 1, the middle of the side of the upper rod frame 1 and the middle of the side of the lower rod frame 2 in the vertical state.

By the above method, the children's fence can be folded more conveniently and quickly.

In the present disclosure, unless otherwise clearly defined and limited, terms such as "interconnected", "connected", "fixed" should be understood in a broad sense, for example, it may be a fixed connection or a detachable connection, or be a whole; it can be an electrical connection; it can be directly connected, or it can be indirectly connected through an intermediate medium, and it can be the communication between the two elements or the interaction relationship between the two elements. For those of ordinary skill in the art, the specific meanings of the above terms in the present disclosure can be understood according to specific situations.

In the description of the present disclosure, numerous specific details are set forth. It will be understood, however, that embodiments of the present disclosure may be practiced without these specific details. In some instances, well-known methods, systems, and techniques have not been shown in detail in order not to obscure an understanding of the description.

In the description of the specification, reference to the terms "one embodiment", "some embodiments", "example", "specific example", or "some examples" or the like meant to be described in conjunction with the embodiments or examples of the specific features, systems, materials or characteristics of the present disclosure are included in at least one embodiment or example of the present disclosure. In the specification, schematic representations of the above terms are not necessarily directed to the same embodiment or example. Furthermore, the particular features, systems, materials, or characteristics described may be combined in any suitable manner in any one or more embodiments or examples. Furthermore, those skilled in the art may combine and group the different embodiments or examples described in the specification and the features of the different embodiments or examples without conflicting each other.

Finally, it should be noted that: the above embodiments are only used to illustrate the technical solutions of the present disclosure, but not to limit it. Although the present disclosure has been described in detail with reference to the foregoing embodiments, those of ordinary skill in the art should be understood that it is still possible to modify the technical solutions recorded in the foregoing embodiments, or to perform equivalent replacements on some or all of the technical features. These modifications or replacements do not make the essence of the corresponding technical solutions deviate from the embodiments of the present disclosure. The scope of the technical solution shall be covered by the scope of the claims and description of the present disclosure.

What is claimed is:

1. A side structure of a fence frame, comprising two vertical struts provided at intervals, wherein between the two vertical struts the fence frame is provided with:

two upper rods provided horizontally, remote ends of the two upper rods being respectively detachably connected to upper ends of the two vertical struts, adjacent ends of the two upper rods being rotatably connected relative to each other, and the two upper rods rotating downward after being disassembled from the upper ends of the two vertical struts to approach each other; and two lower rods provided horizontally, remote ends of the two lower rods being respectively configured to be rotatable relative to lower ends of the two vertical struts, adjacent ends of the two lower rods being rotatably connected relative to each other, and the two lower rods approaching each other by rotating upward relative to the lower ends of the two vertical struts; and two diagonal struts, remote ends of the two diagonal struts being respectively configured to be rotatable relative to the lower ends of the two vertical struts, adjacent ends of the two diagonal struts being respectively rotatably connected to an intersection of the two upper rods, and the two diagonal struts approaching each other by rotating upward relative to the lower ends of the two vertical struts.

2. The side structure of a fence frame according to claim 1, wherein the adjacent ends of the two upper rods and the adjacent ends of the two diagonal struts are rotatably connected to an intermediate connector.

3. The side structure of a fence frame according to claim 1, wherein:

each of the lower ends of the two vertical struts is connected to a lower corner connector, and the remote ends of the two lower rods respectively configured to be rotatable relative to the lower ends of the two vertical struts and the remote ends of the two diagonal struts respectively configured to be rotatable relative to the lower ends of the two vertical struts are respectively rotatably connected to the lower corner connector.

4. The side structure of a fence frame according to claim 1, wherein:

the adjacent ends of the two lower rods are connected by a quick-lock connector, and the quick-lock connector has a first locking position restricting the two lower rods from being rotated relative to each other and a first unlocking position that allows the two lower rods to rotate relative to each other.

5. The side structure of a fence frame according to claim 4, wherein:

the two lower rods are respectively a first lower rod and a second lower rod, the quick-lock connector comprises a first connecting mechanism, a second connecting mechanism and a first spring, the first connecting mechanism is connected with the first lower rod, one end of the second connecting mechanism is connected with the second lower rod and configured to move along a length direction of the second lower rod, the first spring is provided in the second lower rod and abuts between the second connecting mechanism and the second lower rod, and the second connecting mechanism is non-rotatably matched with the first connecting mechanism in the first locking position and is rotatably matched with the first connecting mechanism when moving to the first unlocking position.

6. The side structure of a fence frame according to claim 5, wherein:

the second lower rod is provided with a first bar-shaped hole along the length direction, and the second connecting mechanism is provided in the first bar-shaped hole and configured to move along the first bar-shaped hole.

7. The side structure of a fence frame according to claim 6, wherein:

the first connecting mechanism comprises a first connector and a connecting piece, the first connector is sleeved on an outer periphery of the first lower rod, one end of the connecting piece is disposed in the first lower rod, and the first connector and the connecting piece are fixedly connected with the first lower rod through a fastener.

8. The side structure of a fence frame according to claim 7, wherein:

the second connecting mechanism comprises a first control and a linkage, one end of the linkage is inserted into the second lower rod, a second end of the linkage is non-rotatably matched with the connecting piece, the first control is sleeved on an outer periphery of the second lower rod, and the first control and the linkage are connected in the first bar-shaped hole of the second lower rod.

9. The side structure of a fence frame according to claim 8, wherein:

the second connecting mechanism further comprises a second connector, the second connector is sleeved on the outer periphery of the second lower rod and on outer peripheries of the linkage and the connecting piece, the second connector is located between the first control and the first connector, the second connector is connected with the linkage at a first connecting position and is configured to move along a length direction of the linkage, and the second connector is rotatably connected with the connecting piece at a second connecting position.

10. The side structure of a fence frame according to claim 1, wherein:

each of the two upper rods is detachably connected to the upper end of a corresponding one of the two vertical struts through an upper corner connector, the upper corner connector comprises a fixing piece and a third connecting mechanism detachably connected to the fixing piece, the upper end of the corresponding one of the two vertical struts is fixed on the fixing piece, and each of the two upper rods is fixed on the third connecting mechanism.

11. A fence frame, comprising a plurality of side structures of the fence frame according to claim 1 provided along a peripheral direction, wherein adjacent side structures of the fence frame share a same vertical strut.

12. A fence, comprising the fence frame according to claim 11, a fabric cover covering sides and a bottom of the fence frame, and an operate structure for driving the fence frame to fold to a middle.

13. A method for folding a fence including a fence frame, a fabric cover covering sides and a bottom of the fence frame, and an operate structure for driving the fence frame to fold to a middle, wherein:

the fence frame includes a plurality of vertical struts provided at intervals in a peripheral direction, between adjacent two vertical struts of the plurality of vertical struts is provided:

two upper rods provided horizontally, remote ends of the two upper rods being respectively detachably connected to upper ends of the two vertical struts, adjacent ends of the two upper rods being rotatably connected relative to each other, and the two upper rods rotating downward after being disassembled from the upper ends of the two vertical struts to approach each other;

two lower rods provided horizontally, remote ends of the two lower rods being respectively configured to be rotatable relative to lower ends of the two vertical struts, adjacent ends of the two lower rods being rotatably connected relative to each other, and the two lower rods approaching each other by rotating upward relative to the lower ends of the two vertical struts; and two diagonal struts, remote ends of the two diagonal struts being respectively configured to be rotatable relative to the lower ends of the two vertical struts, adjacent ends of the two diagonal struts being respectively rotatably connected to an intersection of the two upper rods, and the two diagonal struts approaching each other by rotating upward relative to the lower ends of the two vertical struts, and the method for folding comprising steps of:

disassembling the upper rods of the fence frame from the upper ends of the plurality of vertical struts;

rotating the upper rods disassembled from the upper ends of the plurality of vertical struts downward, rotating the lower rods upward relative to the lower ends of the plurality of vertical struts, and rotating the diagonal struts upward relative to the lower ends of the plurality of vertical struts; and driving, by the operate structure, the fence frame to fold to the middle.

* * * * *